US005967312A

United States Patent [19]

Jacobs

[11] Patent Number: 5,967,312

[45] Date of Patent: Oct. 19, 1999

[54] FLIP TOP SMOKING SYSTEM

[76] Inventor: Patrick C. Jacobs, 2258 E. Grand, Springfield, Mo. 65804

[21] Appl. No.: 09/063,015

[22] Filed: Apr. 21, 1998

[51] Int. Cl.[6] ..... A24F 15/00

[52] U.S. Cl. ..... 206/266; 206/242; 131/329

[58] Field of Search ..... 206/86, 87, 242, 206/265, 266; 220/323, 324, 264; 131/329

[56] References Cited

U.S. PATENT DOCUMENTS

| | | | |
|---|---|---|---|
| 595,070 | 12/1897 | Oldenbusch | 206/266 |
| 4,214,658 | 7/1980 | Crow | 206/244 |
| 4,501,378 | 2/1985 | Berfield | 220/324 |
| 4,527,571 | 7/1985 | Djukic | 131/329 |
| 5,035,608 | 7/1991 | Parren | 206/86 |
| 5,465,738 | 11/1995 | Rowland | 131/329 |
| 5,529,078 | 6/1996 | Rehder et al. | 131/175 |

*Primary Examiner*—David T. Fidel
*Attorney, Agent, or Firm*—Patent & Trademark Services; Thomas Zack; Joseph H. McGlynn

[57] ABSTRACT

A flip top container used to store a smoking pipe and smoking material. Pivots mount a side lever and the top lid to the container's body while side panels mounted on the body define two sides of the smoking material chamber. A first biasing spring on the lid engages the top of a stored pipe and acts to raise the lid while a second biasing spring on the lever acts to pivot the lever into engagement with the closed lid top and keep it in that position. When the lever is depressed it pivots on its pin to release the engaged lid which then flips upward by virtue of its biased spring. Complementarily shaped engaged stepped surfaces on the ends of the lever and lid assist in maintaining the lid closed and locked when access to the container is not desired.

6 Claims, 1 Drawing Sheet

FLIP TOP SMOKING SYSTEM

BACKGROUND OF THE INVENTION

Persons who smoke like to have the necessary ingredients stored in a single container to permit their easy transport and use. When pipes are used for the smoking implement various types of containers have been used to store and transport the pipe and the necessary associated smoking material. The present invention relates to one such container wherein a pipe is stored in a container whose lid can be opened by flipping a lever to expose and permit easy access to the pipe and its tobacco.

DESCRIPTION OF THE PRIOR ART

Several types of smoking pipe assemblies are known in the prior art. For example, U.S. Pat. No. 4,214,658 to Crow a smoking pipe and smoking material are stored in a container having a removal upper sliding cover to permit access to the pipe and its smoking material.

In the Djukic patent (U.S. Pat. No. 4,527,571) a key chain attachable container can be disassembled and reassembled to form a pipe for smoking.

The Rehder et al. reference (U.S. Pat. No. 5,529,078) discloses a smoker's box for reducing pollution having a smoke treatment chamber with a box attached mouthpiece.

In U.S. Pat. No. 5,465,738 to Rowland a smoking system is described which holds a smoking device, tobacco, filters and a cleaning rod.

The present invention is a flip top container operable with one finger used to store a smoking pipe and smoking material as more further set forth in this specification.

SUMMARY OF THE INVENTION

This invention relates to a flip top container used to store a smoking pipe and smoking material within its contents. To do so a finger actuated lever releases the upwardly biased top to expose its stored pipe and smoking material and permit their use.

It is the primary object of the present invention to provide for an improved storage container apparatus for a smoking pipe and smoking material.

Another object is to provide for such a container having a flip top lid actuated by depressing a lever.

These and other objects and advantages of the present invention will become apparent to readers from a consideration of the ensuing description and the accompanying drawings.

DESCRIPTION OF THE PREFERRED EMBODIMENT

Figure 1:
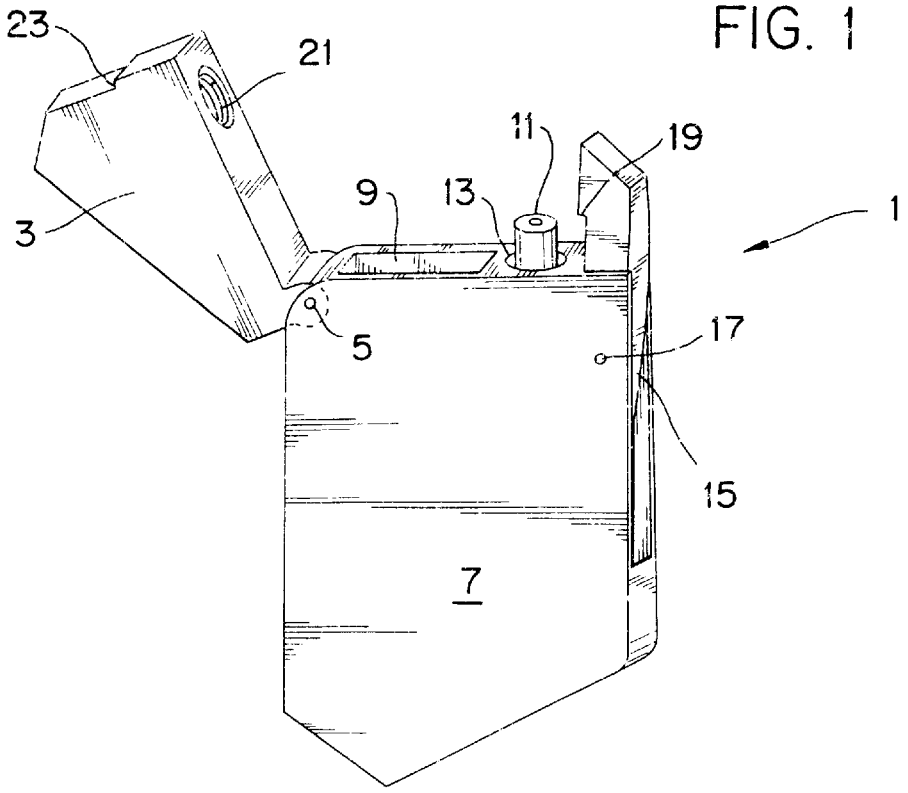
FIG. 1 is a side view of the invention's preferred embodiment.

FIG. 1 is a side view of the invention's preferred embodiment. The storage container 1 has an upper flip top lid 3 shown in its opened position. A pivot pin 5 joins the lid to the container and extends to the container's two side panels. In this view the near front side panel 7 is depicted it being understood that a similarly sized and shaped back panel is located on the container's opposite side. At the container's upper surface the exposed opened top of the container's internal tobacco storage cavity 9 can be seen as well at the tip of the stored pipe 11 located within its cylindrical storage container cavity 13. To the right side of these cavities is the pivotally mounted lever 15.

A hinge pin 17 similar to pin 5 extends into the side panels and acts as the pivot for the lever. The upper lever surface has a notched19 or step discontinuity whose purpose is to lock with the lid. Located on the lower surface of lid3 is a recessed housed spring 21 which is positioned to engage the exposed upper surface of the stored pipe 11 when the lid is closed. On the lid side is another notched or step discontinuity surface 23 whose shape and size complements the shape and size of lever notch or step discontinuity 19 to permit its locking engagement when the lid is closed.

Figure 2:
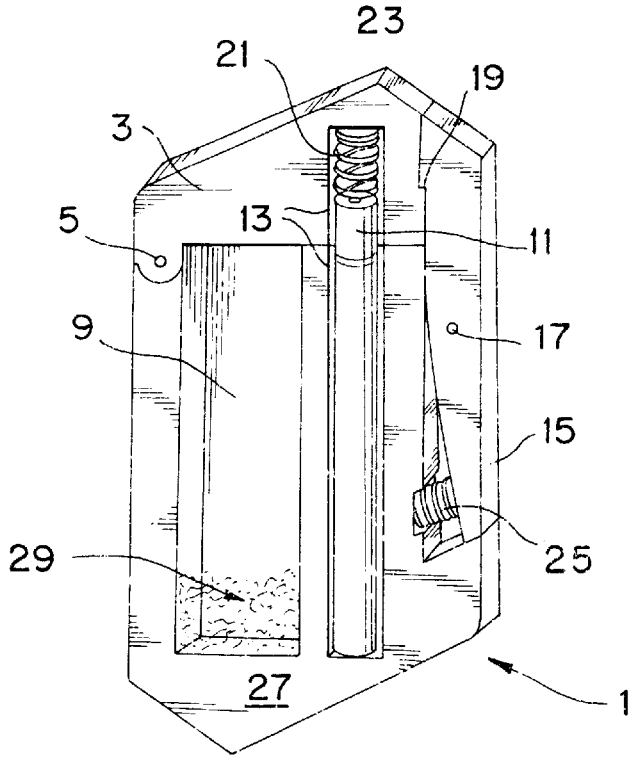
FIG. 2 is a side view of the FIG. 1 embodiment with one of its side panels removed to shown the internal storage container cavities and stored articles.

FIG. 2 is a side view of the FIG. 1 embodiment with its front side panel7 removed to shown the internal storage container cavities and stored articles. In this view the lid 3 is closed with stepped surface 23 smaller lower portion engaged with the lever's complementary stepped surfaced smaller portion19 such that the upper end of the step 19 sits over the lower engaged surface edge of surface23 to lock the two engaged pivotally mounted elements in place.

A spring 25 fitted in an internal bore in the solid container's body 27 biases the lever 15 into the locking engagement with the lid. By depressing the leverl5 below its pivot point 17 the spring's outward biasing action will be overcome and the lever will be freed from its stepped engagement with the lid3. When this happens, the lid's compressed spring 21 forces the lid upward in a flip top motion to expose the internal contents of the container as shown in FIG. 1. As shown in FIG. 2 the container's internal contents may include smoking material such as tobacco29 in the cavity 9 in the body portion 27. Also shown in the same body portion is the other cylindrical storage container cavity 13 for the stored pipe 11.

In use the closed lid 3 is opened by depressing the pivotally mounted lever15 which causes it to flip opened to expose the opened cavity top9 and the top of pipe 11 as in the first figure. Using one's fingers the pipe 11 is pulled upwardly to remove it from the container. To place tobacco 29 or any other smoking material into the pipe, the pipe is pushed into the material's storage chamber and is filled by twisting the pipe's sharp edge against the material which cuts it to fit the bowl of the pipe.

After smoking, the pipe is inserted back into its storage chamber13 and the lid depressed until its notched surface 23 engages the lever's notch 19 while the biasing spring 25 maintains these two elements in their locked state. Since both the lever and lid are pivotally attached to the solid body27 of the container, neither can get lost and can be opened or closed as desired.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A flip top container used to store a smoking pipe and smoking material comprising:

a container have a body with a first storage chamber for a pipe and a second storage chamber for smoking material;

a pivotally mounted lever attached to said container at one side thereof, said lever having an upper stepped surface member; and a pivotally mounted upper lid having an upwardly biasing member and a stepped surface to engage the lever's stepped surface in a closed position whereby depression of the lever will cause the engaged stepped lid and lever surfaces to be disengaged from each other while the lid's biasing member causes the lid to flip to an opened position.

2. The container as claimed in claim 1, wherein said lever has a biasing member which engages the container's body and the lever which acts to maintain the engaged lever and lid surfaces in engagement.

3. The container as claimed in claim 2, wherein said lid's biasing member is a spring located within a recess of the lid that depresses the top surface of a stored pipe.

4. The container as claimed in claim 3, wherein said lid and lever each have a pivot pin which extends into the container's body to permit their respective pivotally motion with respect to the container.

5. The apparatus as claimed in claim 4, wherein said lever's biasing member is a spring mounted within a bore in the container's body.

6. The apparatus as claimed in claim 5, also including front and back container panels mounted to the container's body to define opposite sides of the smoking material's storage cavity.

* * * * *